US011754376B2

(12) United States Patent
Ayre

(10) Patent No.: US 11,754,376 B2
(45) Date of Patent: Sep. 12, 2023

(54) OVERPRESSURE PROTECTION SYSTEM FOR A MAGAZINE

(71) Applicant: RHEINMETALL BAE SYSTEMS LAND LIMITED, Shropshire (GB)

(72) Inventor: Gareth David Ayre, Washington Tyne and Wear (GB)

(73) Assignee: RHEINMETALL BAE SYSTEMS LAND LIMITED, Shropshire (GB)

( * ) Notice: Subject to any disclaimer, the term of this patent is extended or adjusted under 35 U.S.C. 154(b) by 11 days.

(21) Appl. No.: 17/621,318

(22) PCT Filed: Jun. 18, 2020

(86) PCT No.: PCT/GB2020/051469
§ 371 (c)(1),
(2) Date: Dec. 21, 2021

(87) PCT Pub. No.: WO2020/260860
PCT Pub. Date: Dec. 30, 2020

(65) Prior Publication Data

US 2022/0357133 A1 Nov. 10, 2022

(30) Foreign Application Priority Data

Jun. 25, 2019 (GB) ..... 1909094

(51) Int. Cl.
*F41H 5/20* (2006.01)
*F41H 7/03* (2006.01)
(Continued)

(52) U.S. Cl.
CPC ..... *F41H 5/20* (2013.01); *F41H 7/03* (2013.01); *F41H 7/048* (2013.01); *F42B 39/20* (2013.01)

(58) Field of Classification Search
CPC . F42B 39/20; F41H 7/048; F41H 7/03; F41H 5/20
(Continued)

(56) References Cited

U.S. PATENT DOCUMENTS 2,123,662 A * 7/1938 Gwynne ..... F16K 17/16 220/89.2
3,062,574 A 11/1962 Buntenbach et al.
(Continued)

FOREIGN PATENT DOCUMENTS

EP 1508768 A1 2/2005
WO 2020260860 A1 12/2020

OTHER PUBLICATIONS

International Search Report and Written Opinion received for PCT Application No. PCT/GB2020/051469, dated Sep. 25, 2020. 13 pages.
(Continued)

*Primary Examiner* — John Cooper
(74) *Attorney, Agent, or Firm* — FINCH & MALONEY, PLLC

(57) ABSTRACT

An overpressure protection system (30) for a magazine (10) for storing explosive materials. The magazine (10) comprises a wall (12) which defines an internal chamber (14) for housing the explosive materials, with a first aperture (20) defined in the wall (12). The overpressure protection system (30) is configured to close the first aperture (20). The system (30) comprises a burst disc diaphragm (32) for covering the first aperture (20), and a protective cover (34) for locating outside of the chamber (14) and over the burst disc diaphragm (32). The protective cover (34) is spaced apart from the burst disc diaphragm (32) to form a cavity (38) with an opening (36) for venting fluid from the cavity (38).

18 Claims, 6 Drawing Sheets

(51) Int. Cl.
*F41H 7/04* (2006.01)
*F42B 39/20* (2006.01)

(58) Field of Classification Search
USPC ..... 86/50; 89/36.13
See application file for complete search history.

(56) References Cited

U.S. PATENT DOCUMENTS 3,392,489 A * 7/1968 Johnson ..... E06B 5/12 52/456
3,435,984 A * 4/1969 Damiani ..... F16K 17/162 220/89.2
4,245,749 A * 1/1981 Graves ..... F16K 17/16 220/663
4,438,677 A * 3/1984 Spotzl ..... F42B 39/20 89/36.13
4,498,261 A * 2/1985 Wilson ..... B65D 90/36 220/89.2
4,612,739 A * 9/1986 Wilson ..... F16K 17/162 220/89.2
5,284,082 A 2/1994 Sprafke et al.
6,607,003 B1 * 8/2003 Wilson ..... F16K 17/16 137/68.27
7,798,893 B2 * 9/2010 Eijkelenberg ..... E05C 19/00 137/71
2004/0172889 A1 * 9/2004 Eijkelenberg ..... B65D 90/36 52/99
2008/0041454 A1 * 2/2008 Eijkelenberg ..... F16K 17/162 137/68.23

OTHER PUBLICATIONS

Search Report under Section 17(5) received for GB Application No. 1909094.3, dated Nov. 5, 2019. 3 pages.
International Preliminary Report On Patentability received for PCT Application No. PCT/GB2020/051469, dated Jan. 6, 2022. 7 pages.

* cited by examiner

OVERPRESSURE PROTECTION SYSTEM FOR A MAGAZINE

The present disclosure relates to an overpressure protection system for a magazine.

In particular the disclosure is concerned with an overpressure protection system for a magazine for storing explosive materials.

BACKGROUND

Some vehicles, for example military vehicles, have a requirement to carry explosive materials.

Obviously these are highly dangerous and must be kept in a container which offers some protection against external hazards and threats and also protects a vehicle crew should an explosive event occur.

In one example this is achieved with an armoured cabinet which sits external to a crew chamber of the vehicle. The cabinet can be accessed by a crew chamber through a crew door. The cabinet is provided with a further opening, which opens to atmosphere, with an armour plate sealing the opening.

The cabinet assembly is configured with the intention that, during an event in the cabinet, the armour plate lifts up, exposing the external opening, and creates an open side for the material inside the cabinet to escape and/or for the pressure of the explosion to be directed to atmosphere (i.e. to the outside of the cabinet and vehicle), and thus maintain the crew door in place so contaminants and debris do not enter the crew chamber. However, there may be a lag between the event and the armour plate being lifted sufficiently to provide the desired effect.

Hence a system which allows for secure and armoured storage of explosive materials on a vehicle, but also reduces the likelihood of harm to the vehicle and vehicle crew in the event of an explosive event, is highly desirable.

SUMMARY

According to the present disclosure there is provided apparatus as set forth in the appended claims. Other features of the invention will be apparent from the dependent claims, and the description which follows.

Accordingly there may be provided an overpressure protection system (30) for a magazine (10) for storing explosive materials. The magazine (10) may comprise a wall (12) which defines an internal chamber (14) for housing the explosive materials, with a first aperture (20) defined in the wall (12). The overpressure protection system (30) may be provided for closing the first aperture (20). The system (30) may comprise: a burst disc diaphragm (32) for covering the first aperture (20) and a protective cover (34) for locating outside of the chamber (14) and over the burst disc diaphragm (32). The protective cover (34) may be spaced apart from the burst disc diaphragm (32) to form a cavity (38) with an opening (36) for venting fluid from the cavity (38).

The burst disc diaphragm (32) may be configured to rupture at a first condition defined as a function of pressure and/or rate of change of pressure. The protective cover (34) may be configured to open at the first condition.

The burst disc diaphragm (32) may comprise weakened regions (40) in a predetermined pattern configured to fail at the first condition.

The overpressure protection system (30) may further comprise a mount (50) for fixing the protective cover (34) relative to the wall (12) of the magazine (10), the mount (50) configured to space the protective cover (34) apart from the burst disc diaphragm (32).

The overpressure protection system (30) may further comprise a baffle wall (60) which extends around, and is spaced apart from, the periphery (62) of the protective cover (34) to define a part (56) of a flow path (52) between the cavity (38) and the cavity opening (36).

The protective cover (34) may be provided as a first panel (70) fixed to the mount (50), the mount comprising a frangible fixture (72) configured to break at the first condition to allow the cover (34) to open.

The system (30) may comprise a plurality of mounts (50), and the protective cover (34) may be fixed to the plurality of mounts (50), each mount (50) comprising a frangible fixture (72) which hold the protective cover (34) in place relative to the wall (12) such that after all of the frangible fixtures (72) have broken, the protective cover (34) is removeable from the mounts (50).

The first panel (70) may be pivotably mounted by a first hinge (74), such that the first panel (70) is operable to pivot open about the hinge (74) when the frangible fixture (72) is broken.

The protective cover (34) may comprise a second panel (80) pivotably mounted by a second hinge (84), such that: in a first configuration, edges (76, 86) of the first panel (70) and second panel (80) join to close the first aperture (20); and in a second configuration, the first panel (70) and second panel (80) are pivoted about their respective hinges such that the panel edges (76, 86) are spaced apart to open the first aperture (20).

The edges (76, 86) may overlap, and the frangible fixture (72) may extend through the overlapped edges (76, 86) of the first panel (70) and the second panel (80).

A damping seal (90) may be provided on at least one of the edges (76, 86) of the first panel (70) and the second panel (80) in the region where the edges (76, 86) overlap.

There may also be provided a vehicle (200) comprising a magazine (10) fitted with an overpressure protection system (30) according to the present disclosure.

The wall (12) may define a second opening (100) closed by a crew door (102) for access by a crew member.

The vehicle (200) may be a tank with a rotatable turret (202), and the magazine (10) may comprise part of the turret (202).

Hence there is provided an overpressure protection system 30 which may form part of a magazine 10 mounted to a vehicle, for example a battle tank, other military or law enforcement vehicle. There may also be provided a magazine 10, for mounting to such a vehicle, the magazine comprising an overpressure protection system 30. The overpressure protection system is configured to act to release pressure as quickly as possible from a chamber inside the magazine to which it is attached whilst still allowing for armoured protection for the contents of the magazine. This reduces the risk of injury to a vehicle crew as well as reducing the chance of damage to the vehicle as the result of an explosive event in the magazine, thereby keeping the vehicle and crew in operation.

BRIEF DESCRIPTION OF THE DRAWINGS

Examples of the present disclosure will now be described with reference to the accompanying drawings, in which.

DETAILED DESCRIPTION

The present disclosure relates to an overpressure protection system 30 which may be provided as part of, or fitted to, a magazine 10 for storing explosive materials. The present disclosure also relates to a magazine 10 for storing explosive materials comprising an overpressure protection system 30. The magazine 30 may be provided on and/or part of, a vehicle, for example a military or law enforcement vehicle. In the example shown in FIG. 1 the vehicle is shown as a battle tank 200. In each case, the vehicle is configured to contain explosive materials which need to be accessed by a vehicle crew member.

Figure 1:
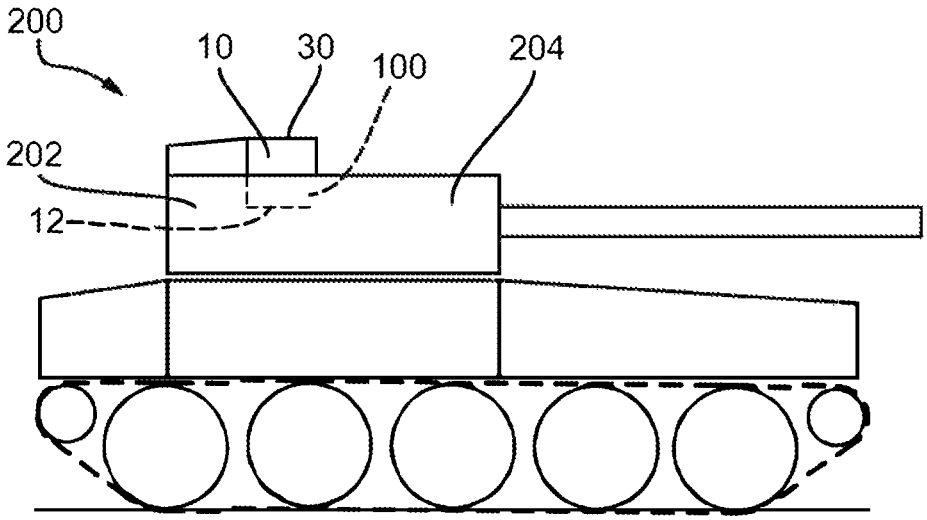
FIG. 1 shows a vehicle comprising a magazine and overpressure protection system according to the present disclosure.
Figure 2:
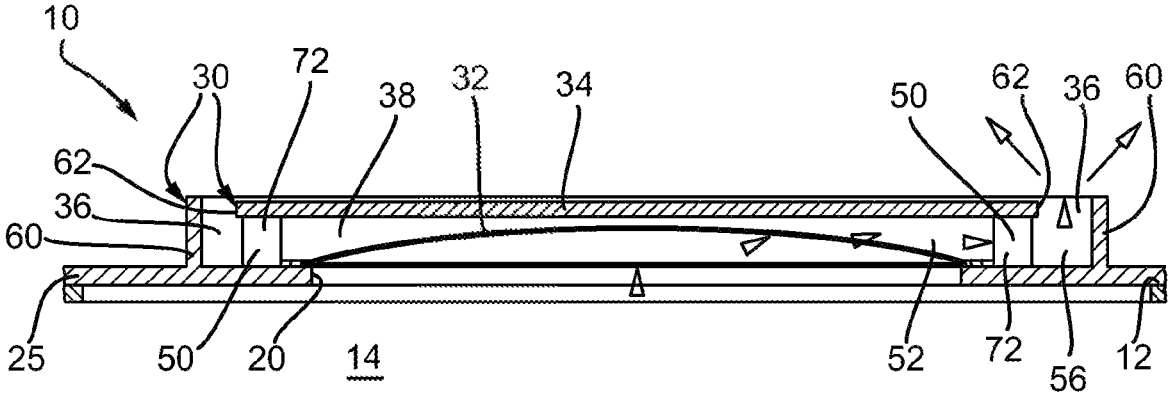
FIG. 2 shows a cross sectional area of the overpressure protection system.
Figure 3:
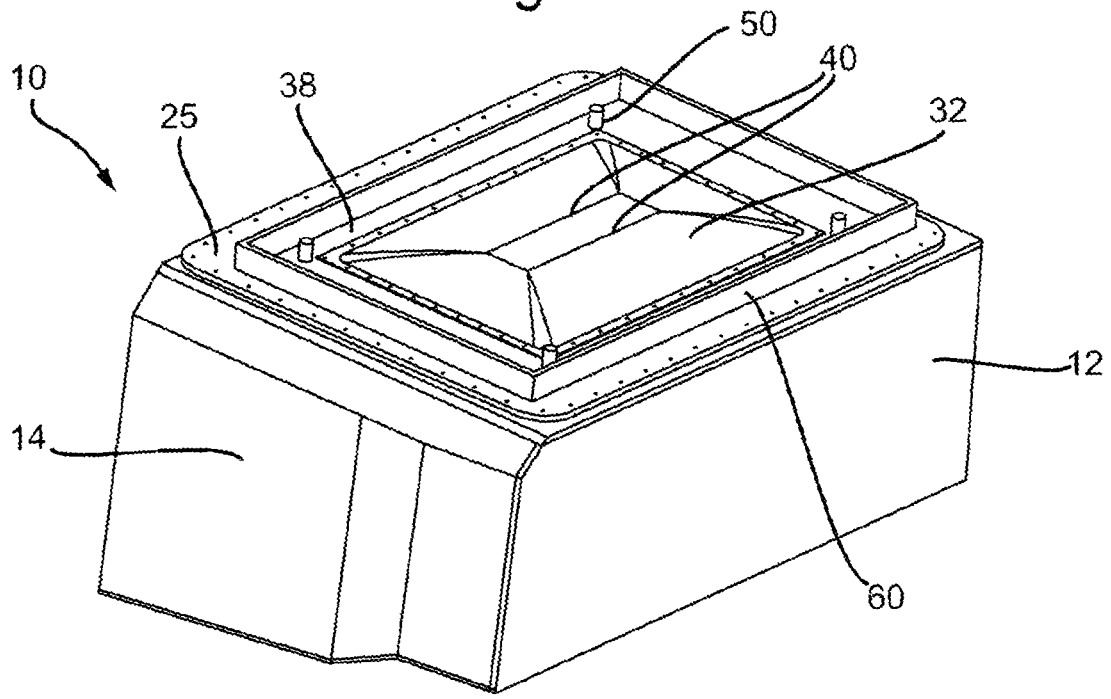
FIG. 3 shows a top view of the magazine and overpressure protection system with a protective cover removed.
Figure 4:
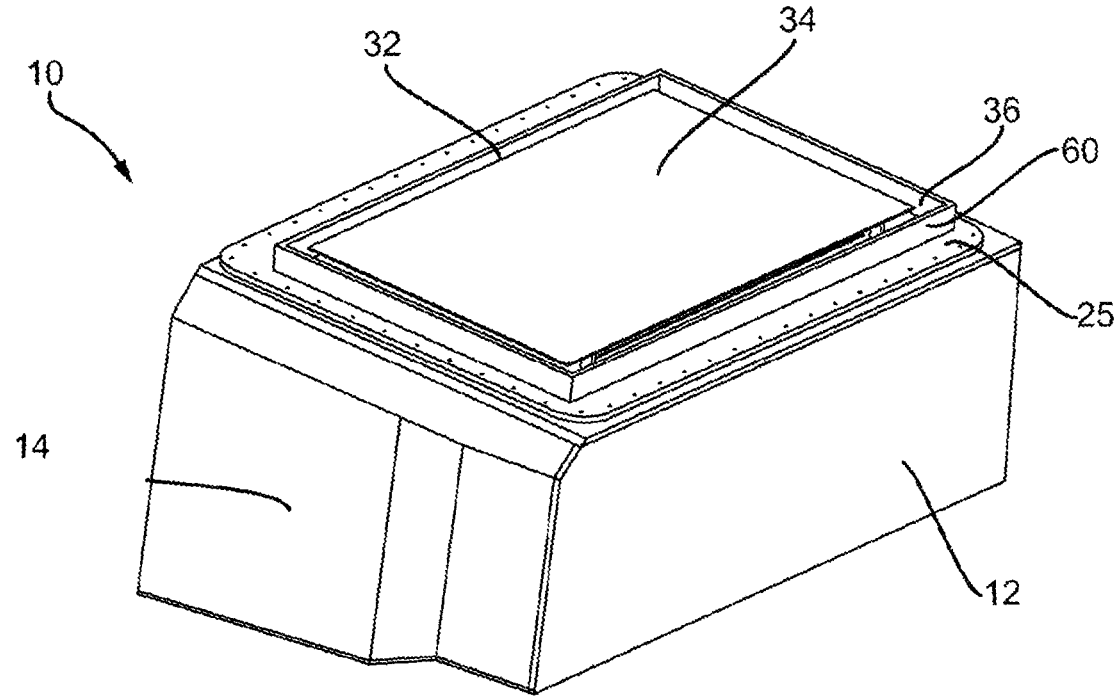
FIG. 4 shows the same view as FIG. 3 with a protective cover in place.
Figure 5:
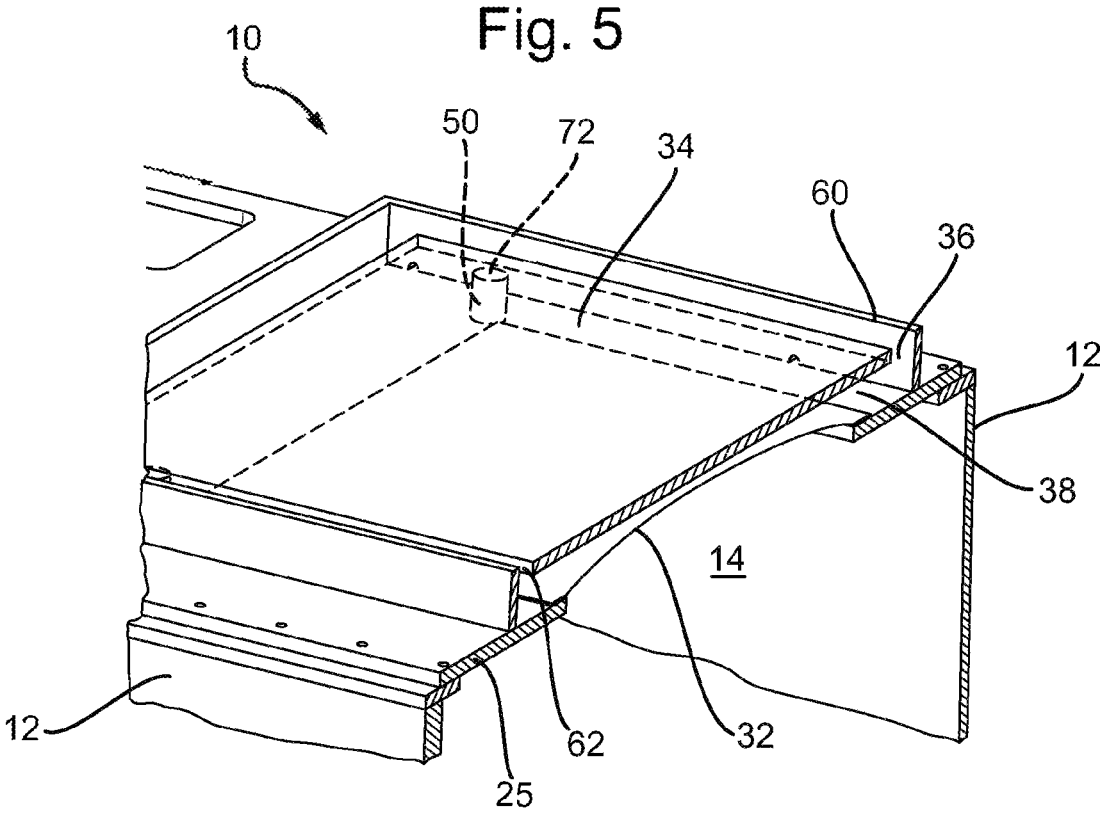
FIG. 5 shows an enlarged part sectional view of the arrangement shown in FIG. 4 with the protective cover shown partially transparent to show features of the system underneath.

In the example of FIG. 1 the vehicle 200 is a tank with a rotatable turret 202. The magazine 10 is provided on and/or part of the turret 202, and may extend into, form a part of and/or be accessible from a crew chamber 204 defined by the turret 202. An enlarged cross-sectional view of the overpressure protection system 30 is shown in FIG. 2. An example of a magazine 10 and overpressure protection system 30 are shown in FIGS. 3 to 5. A further example of an overpressure protection system 30 is shown in FIGS. 7 to 10. Details of the magazine 10 and vehicle 200 are common to both examples.

As best shown in FIG. 5, the magazine 10 comprises a wall 12 which defines an internal chamber 14 for housing explosive materials. The magazine 10 further comprises a first aperture 20 defined in the wall 12, the first aperture 20 being closed by the overpressure protection system 30. The overpressure protection system 30 comprises a burst disc diaphragm 32 which covers the first aperture 20. That is to say, the burst disc diaphragm 32 spans, seals and/or closes the first aperture 20. Hence the burst disc diaphragm 32 fluidly seals the first aperture 20 in the wall 12 so that fluid (for example gas and/or liquid) and/or particulates cannot enter the internal chamber 14 via the burst disc diaphragm 32 while the burst disc diaphragm is intact. In FIG. 3 the burst disc diaphragm 32 is shown covering the first aperture 20. FIG. 4 shows a protective cover 34 provided outside of the chamber 14 and over the burst disc diaphragm 32 to provide ballistic protection to the burst disc diaphragm 32 and chamber 14 of the magazine 10. The protective cover 34 is spaced apart from the burst disc diaphragm 32, as shown in FIGS. 2, 5 to form a cavity 38 with an opening 36. That is to say, the cover 34 is provided over the top of the burst disc diaphragm 32 and a volume (i.e. the cavity 38) is defined between the protective cover 34 and burst disc diaphragm 32. The opening 36, which may extend around the edges of the cover 34, may be provided with an appropriate throat area for venting fluid from the cavity 38.

A baffle wall 60 extends around, and is spaced apart from, the periphery (i.e. edge) 62 of the protective cover 34 to define a part 56 of a flow path 52 between the cavity 38 and the cavity opening 36. The baffle wall 60 extends in a direction away from the internal chamber 14 of the magazine 10. As shown in the figures, the baffle wall 60 extends around, and is spaced apart from, the periphery/edge of the burst disc diaphragm 32 as well as being spaced apart from the periphery/edge 62 of the protective cover 34.

Hence the opening 36 may extend all of the way around the cover 34. That is to say the opening 36 is defined between the cover 34 and the baffle wall 60 next to which the cover 34 is mounted.

Hence the baffle wall 60, protective cover 34, burst disc diaphragm 32 and aperture 20 are arranged, and configured to be arranged, relative to one another so that the cavity 38 and opening 36 define a labyrinthine (i.e. convoluted, indirect) flow path between the aperture 20 and opening 36.

The burst disc diaphragm 32 is configured to rupture at a first condition defined as a function of pressure and/or rate of change of pressure within the chamber 14, for example because of an explosive event within the chamber 14. The protective cover 34 is configured to open, that is to say to be released, to uncover the aperture 20 at the first condition.

The burst disc diaphragm 32 may comprise one or more weakened regions 40. The or each weakened region 40 may be provided in a predetermined pattern configured to fail at the first condition. The weakened regions 40 may be provided by forming grooves on the material of the diaphragm 32, stamping the material of the diaphragm 32 and/or or etching the material of the diaphragm 32. However formed, the weakened regions 40 are provided to ensure that the burst disc diaphragm 32 ruptures in a particular way (i.e. in a particular pattern) at the first condition.

The weakened regions 40 may be formed so that the largest possible aperture will appear in the burst disc 32 so that pressure and debris can be released from the magazine with as little hindrance as possible. The weakened regions 40 may be formed so that an aperture will appear in the burst disc 32 sufficient to allow pressure and debris to be released from the magazine with as little hindrance as possible.

The burst disc diaphragm 32 may comprise a sheet material. For example, the burst disc diaphragm 32 may be provided as an aluminium sheet, or comprise an aluminium sheet. Other metals, alloys and materials may also be used to form the burst disc diaphragm 32.

The protective cover 34 is carried on the wall 12 of the chamber 14 via a mount 50 which spaces the protective cover 34 apart from the burst disc diaphragm 32. Put another way, the protective cover 34 is fixed relative to the wall 12 of the chamber 14 via the mount 50, and the mount 50 spaces the protective cover 34 apart from the burst disc diaphragm 32. The mount 50 may extend from the wall 12 of the magazine 10, or may extend from a frame 25 which comprises part of the overpressure system 30, the frame 25 being fixed to the wall 12 of the magazine. The baffle wall 60 may extend from the frame 25. As shown in the figures, the aperture 20 is in part covered by the frame 25. That is to say, the frame 25 may extend to either side of the edge of the first aperture 20 so that the frame 25 may be anchored to the wall 12 (for example by bolts and/or welding) and also extend over the edge of the aperture 20 to partly restrict and reinforce the edges of aperture 20.

As shown in the example of FIGS. 4, 5 the protective cover 34 is provided as a first panel 70 fixed to the mount 50. That is to say the protective cover 34 may be provided as a single panel 70. The mount 50 comprises a frangible fixture 72 configured to break at the first condition to thereby open the cover 34 and expose the first aperture 20. The frangible fixture 72 may be provided as a bolt which extends through the cover panel into the mount 50, or some other form of frangible feature which breaks under a certain pressure/force.

The protective cover 34 may be fixed to a plurality of mounts 50, each mount 50 comprising a frangible feature 72 which holds the protective cover 34 in place relative to the wall 12 and/or frame 25, such that after all of the frangible features 72 have broken, for example in response to an explosive event, the protective cover 34 is removable from the mount 50. Put another way, the protective cover 34 may be fixed to the wall 12 of the magazine 10 by a plurality of mounts 50 with a frangible fixture 72, configured such that once all of the frangible fixtures 72 have been broken, then the protective cover 34 may be removed, or blown off, to expose the aperture 20.

Hence the diaphragm 32 will allow pressure waves and pressurised gas/fluid in the chamber 14 to escape around the underside of the protective cover 34 through the cavity 38 and opening 36 during the time when the fixtures 72 are in the process of being broken by the force/pressure of the event. Put another way, diaphragm 32 will fail before the cover 34 is opened, which allows pressure waves and pressurised gas/fluid in the chamber 14 to escape around the underside of the protective cover 34 through the cavity 38 and opening 36 before the fixtures 72 have failed, and before the cover 34 has opened. This two stage approach provides earlier pressure relief in the chamber than possible with examples of the related art.

Figure 6:
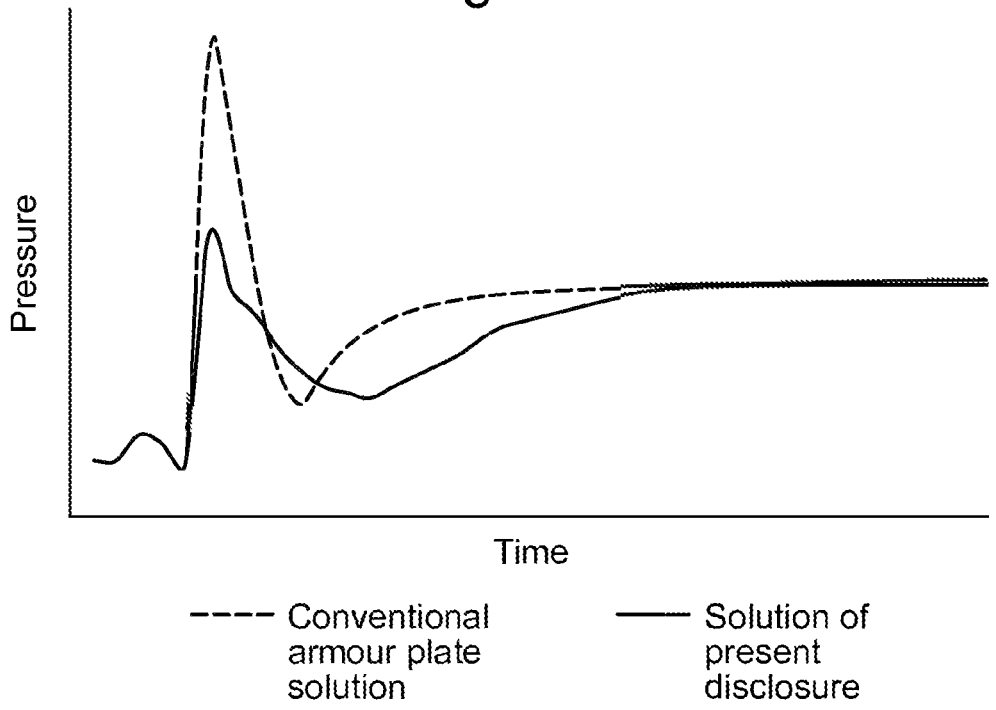
FIG. 6 shows a graph of pressure versus time during an event in a conventional magazine of the related art and an event in a magazine according to the present disclosure.

FIG. 6 illustrates a change of pressure with time inside a cabinet of an example of the related art using a traditional armour plate and mounting (referred to in the Background Section) and the two stage diaphragm and cover 34 arrangement of a magazine 10 with an overpressure protection system 30 of the present disclosure. As can be seen, the rate of pressure rise and maximum pressure within the magazine 10 is lower with an arrangement of the present disclosure than for the conventional arrangement.

In a further example shown in FIGS. 7 to 10, the cover 34 comprises a first panel 70 which is pivotally mounted to the magazine wall 12, frame 25 and/or baffle wall 60 by a first hinge 74, such that the first panel 70 is operable to pivot open relative to the magazine wall 12, frame 25 and/or baffle wall 60 when the frangible fixture holding it is broken, to thereby open the cover 34 and expose the aperture 20 and/or burst disc diaphragm 32. Hence the cover 34 may comprise a single hinged panel 70 covering the aperture 20 and/or burst disc diaphragm 32. In the examples shown in the figures, two hinged panels 70, 80 are shown.

Hence the protective cover 34 may alternatively comprise a first panel 70 and a second panel 80, where the second panel 80 is pivotally mounted to the magazine wall 12, frame 25 and/or baffle wall 60 by a second hinge 84, such that in a first configuration joining/mating edges 76, 86 of the first panel 70 and second panel 80 overlap to close the first aperture 20 and/or cover the burst disc diaphragm 32. For the avoidance of doubt, the joining/mating edges 76, 86 are the edges of the first panel 70 and second panel 80 respectively which are distal to the region of the panels which are connected by respective hinges 74, 84 to the wall 12 of the magazine 10 and/or baffle wall 60 of the overpressure protection system 30. Put another way, the joining/mating edges 76, 86 are the edges of the cover panels 70, 80 which join/mate together when the cover 34 (comprising the panels 70, 80) is closed, thereby forming a seal to prevent ingress of fluid, particulates or foreign bodies to the burst disc diaphragm 32.

In a second configuration the first panel 70 and second panel 80 are pivoted about their respective hinges 74, 84 such that the panel joining/mating edges 76, 86 are spaced apart to open the panels 70, 80, exposing the first aperture 20 and/or burst disc diaphragm 32.

The first panel 70 and/or second panel 80 may be configured to be armoured, for example by choice of material and/or thickness of material.

The edges 76, 86 are configured such that they form a ballistic lap joint when in the first configuration.

A frangible fixture 72 may extend through the overlapped edges 76, 86 of the first panel 70 and the second panel 80. A lug 75, 85 may extend from each of the first panel 70 and second panel 80 respectively at a side edge of the first panel 70 and second panel 80 respectively, where the lug 75 is an extension of the edges 76, 86 of the panel 70, 80, also forming an overlapping joint, with a fixture 72 extending through the lugs 75, 85 into a mount 50.

A damping seal 90 may be provided on at least one of the edges 76, 86 of the first panel and the second panel 80 in the region where the edges 76, 86 overlap. The damping seal 90 may be provided between the edges 76, 86 of the first panel 70 and the second panel 80, the seal 90 configured absorb vibrations induced in the panels 70, 80 during operation of a vehicle to which the system is attached.

Figure 7:
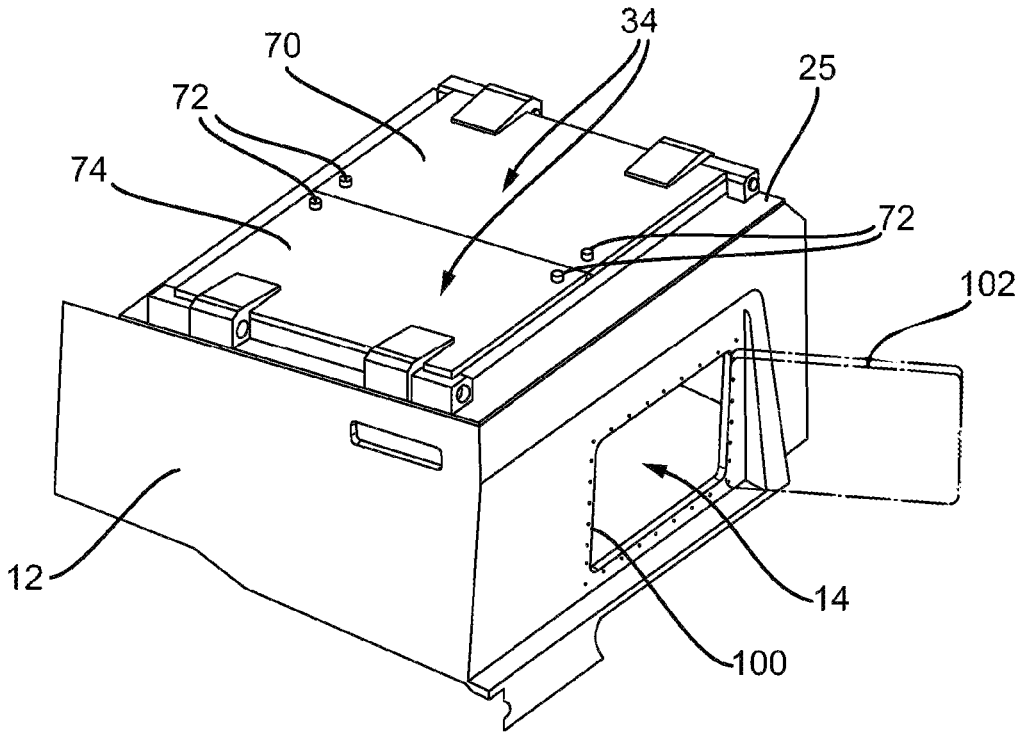
FIG. 7 shows an example of an alternative overpressure protection system according to the present disclosure.
Figure 8:
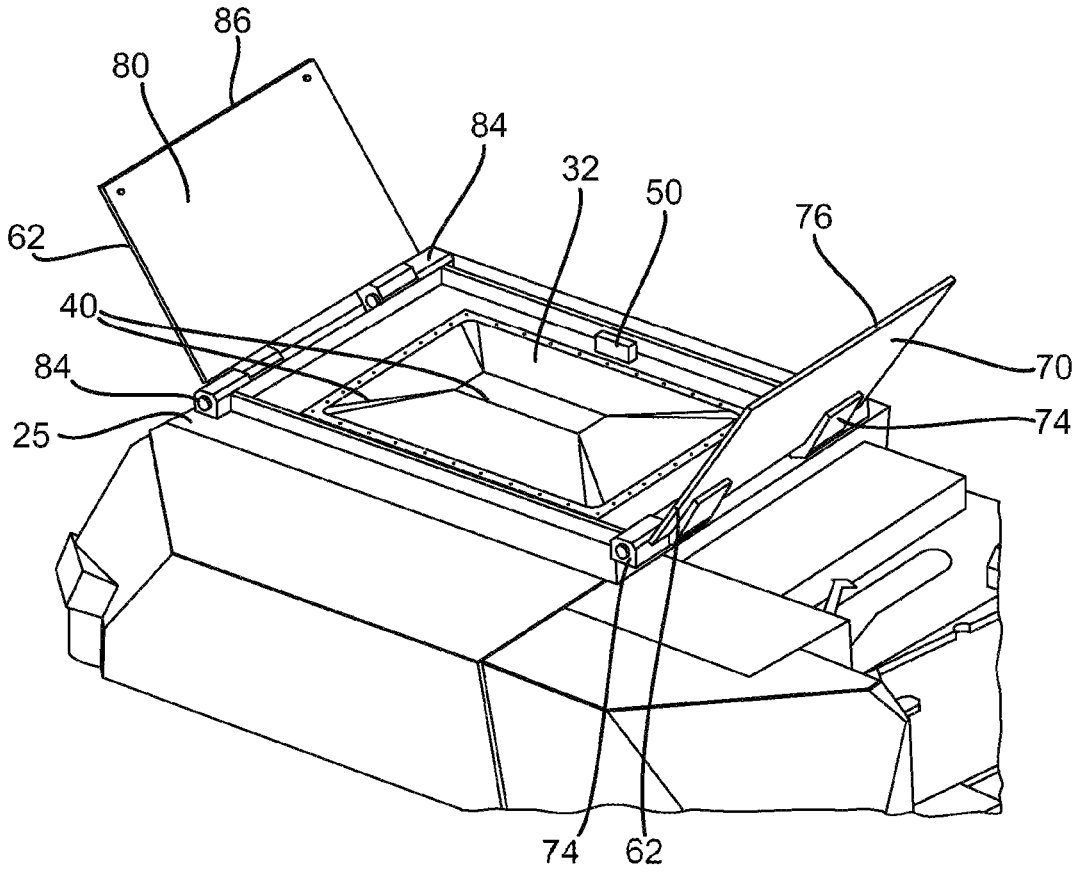
FIG. 8 shows an enlarged view of the system shown in FIG. 7.
Figure 9:
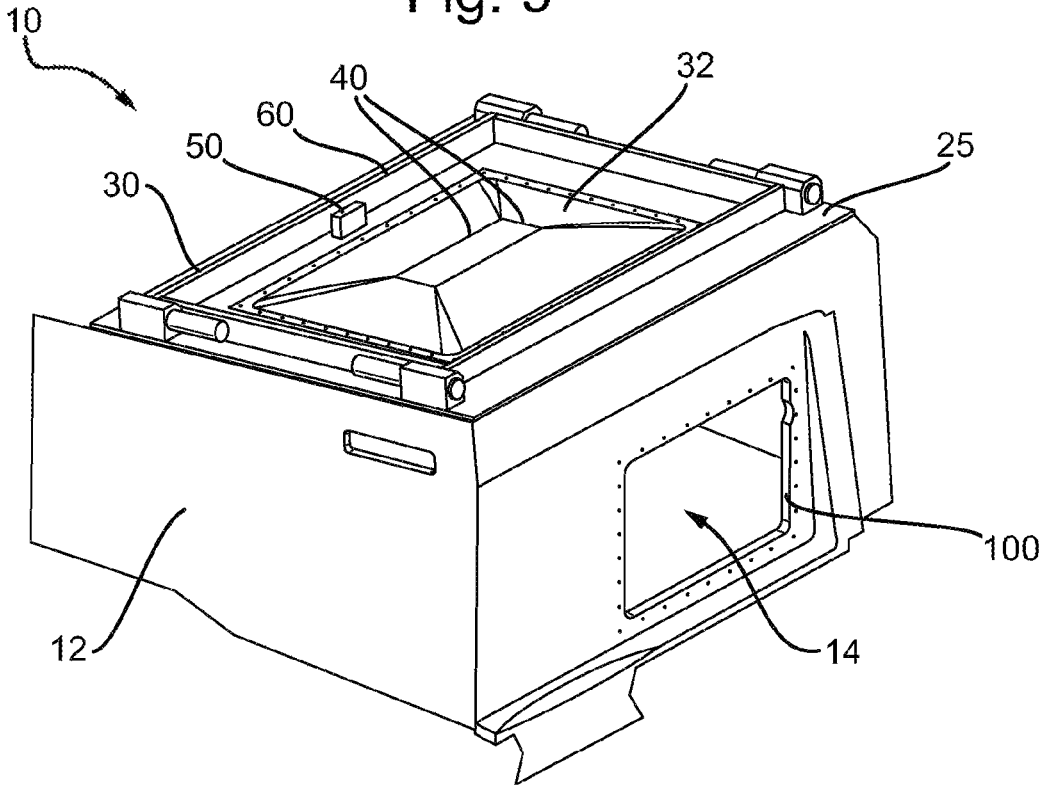
FIG. 9 shows the same view presented in FIG. 7 with hinged cover panels removed.
Figure 10:
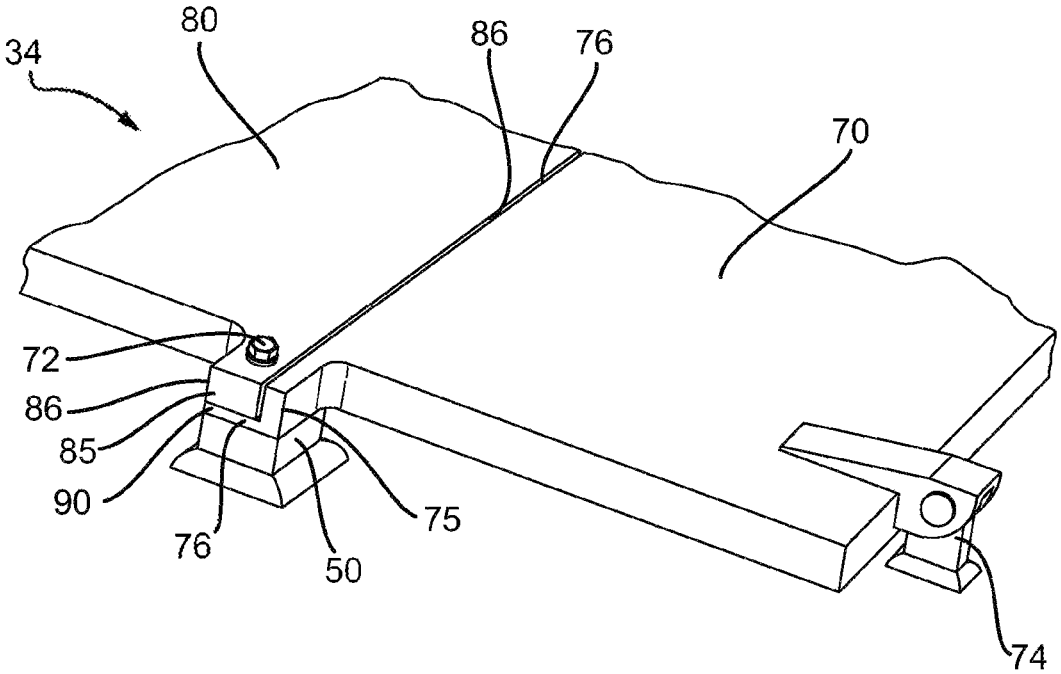
FIG. 10 shows an enlarged view of the panels of the examples of FIG. 7, 8.

The wall 12 of the magazine 10 may define a second opening 100 closable by a crew door 102 for access by a user (e.g. a crew member), as shown in FIG. 7. The opening 100 is shown in FIG. 9 without the crew door 102. An airtight seal may be provided between the crew door 102 and the wall 12 to prevent gas and particulates from passing from the chamber 14 in to crew chamber 204 (shown in FIG. 1).

Hence in operation of the example of FIGS. 7 to 10, an event inside the chamber 14 which breaches the diaphragm 32 will start to act upon the frangible fixture 72 of the mounts 50. The pressurised gas/fluid inside the chamber 14 is directed to pass through the cavity 38 and opening 36 around the edge of the door panels 70, 80 to provide a first stage pressure release while the fixtures 72 complete their failure to allow the door panels 70, 80 to fold back on their hinges 74, 84, forced open by the pressure releases of the event, to expose the first opening 20 beneath the diaphragm 32.

In operation of both examples there is thus provided a two-stage overpressure protection system.

In a first stage the fast acting burst disk diaphragm 32 enables explosion gases to vent rapidly from the magazine into a void (i.e. the cavity 38) under the ballistic compensation (i.e. blow off panel assembly provided as the cover 34, which may be provided as a single fixed panel as shown in FIGS. 2 to 5, a single hinged panel 70, or dual hinged panels 70, 80 as shown in FIGS. 7 to 10). Gases vent through the labyrinthine path defined by the cavity 38 and opening 36 to control the magnitude of an initial transient pressure peak during a dwell period caused by the inertia of the cover 34.

In a second stage, it is the removal/opening of the blow off panel assembly (i.e. cover 34) of the example of FIGS. 2 to 5 (or hinged door/panels 70, 80 of FIGS. 7 to 10) which vents the bulk of the explosion gases.

The two-stage relief mechanism reduces the initial pressure peak in the magazine 10 during an initiation/explosion event and thus improves the platform (i.e. vehicle and crew) survivability.

There is thus provided a system for managing a very high peak pressure in a magazine using a two stage pressure relief concept.

A light frangible diaphragm 32 and ballistic protection in the form of a cover 34 or hinged panel door, or doors 70, 80, are combined with a surrounding labyrinth flow path to an opening 36 which is configured with an appropriate throat area to vent high transient pressure at the start of the explosive event.

This enables a venting process to begin sooner than in examples of the related art, and then provides a damping effect to the high over and under pressures as further explosions initiate in the magazine.

The hinged doors 70, 80 provide a very fast response time, their relatively low inertia further reducing the energy required to vent the magazine, thus shortening the response time in an explosive event. The doors are highly responsive because, being hinged, less force is required to open than would be required to blow off a panel entirely. Also, if two doors 70, 80 are provided, they are inherently half the weight of a full blow off panel spanning the same distance.

The overpressure system 30 of the present disclosure reduces the chance of a crew access door to the magazine opening or being breached.

Since the system provides such a good solution, and the chance of breach of the crew door is minimised, then the walls of the magazine do not need to be as thick as in examples of the related art, and hence can be lighter. Hence the magazine may be larger (i.e. have more internal volume) for the same weight, and hence carry extra load. Alternatively, the magazine can be lighter so that the vehicle to which it is attached can be lighter and more manoeuvrable. If fitted to a turret of a battle tank, a saving on weight of the magazine means less power is required to turn the turret. Hence having a lighter magazine means that the vehicle and/or turret may be more responsive. Hence not only does the overpressure system of the present disclosure provide a system for actually protecting the crew better compared to examples of the related art, it also provides mean for increasing the performance of the vehicle to which it is attached.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An overpressure protection system for a magazine for storing explosive materials, the magazine comprising a wall which defines an internal chamber for housing the explosive materials, with an aperture defined in the wall, the overpressure protection system comprising:

a burst disc diaphragm for covering the aperture;

a protective cover for locating outside of the chamber and over the burst disc diaphragm, the protective cover being spaced apart from the burst disc diaphragm to form a cavity with an opening for venting fluid from the cavity; and a mount for fixing the protective cover relative to the wall of the magazine, the mount configured to space the protective cover apart from the burst disc diaphragm, wherein the protective cover is provided as a panel fixed to the mount, the mount comprising a frangible fixture configured to rupture to allow the protective cover to open.

2. The overpressure protection system of claim 1, wherein:

the burst disc diaphragm is configured to rupture at a condition defined as a function of pressure and/or rate of change of pressure; and the protective cover is configured to open at the condition.

3. The overpressure protection system of claim 2, wherein the burst disc diaphragm comprises weakened regions in a predetermined pattern configured to fail at the condition.

4. The overpressure protection system of claim 1, comprising:

a baffle wall which extends around, and is spaced apart from, the periphery of the protective cover to define a part of a flow path between the cavity and the cavity opening.

5. The overpressure protection system of claim 1, wherein the mount is one of a plurality of mounts, and the protective cover is fixed to the plurality of mounts, each of the plurality of mounts comprising a frangible fixture configured to retain the protective cover in place relative to the wall such that the protective cover is removeable from the plurality of mounts after rupturing the frangible fixture of all of the plurality of mounts.

6. The overpressure protection system of claim 1, wherein:

the panel is pivotably mounted by a hinge, such that the panel is operable to pivot open about the hinge when the frangible fixture is ruptured.

7. The overpressure protection system of claim 6, wherein the panel is a first panel and the hinge is a first hinge, and the protective cover comprises a second panel pivotably mounted by a second hinge, such that:

in a first configuration, edges of the first panel and second panel join to close the aperture; and in a second configuration, the first panel and second panel are pivoted about their respective hinges such that the panel edges are spaced apart to open the aperture.

8. The overpressure protection system of claim 7, wherein:

the edges overlap, and the frangible fixture extends through the overlapped edges of the first panel and the second panel.

9. The overpressure protection system of claim 7, wherein:

a damping seal is provided on at least one of the edges of the first panel and the second panel in a region where the edges overlap.

10. A vehicle comprising a magazine fitted with the overpressure protection system of claim 1.

11. The vehicle of claim 10, wherein the wall defines an opening closed by a crew door for access by a crew member.

12. The vehicle of claim 10, wherein:

the vehicle is a tank with a rotatable turret, and the magazine comprises part of the turret.

13. An overpressure protection system for a magazine for storing explosive materials, the magazine comprising a wall which defines an internal chamber for housing the explosive materials, with an aperture defined in the wall, the overpressure protection system comprising:

a burst disc diaphragm for covering the aperture, the burst disc diaphragm including one or more weakened regions configured to fail at a condition defined as a function of pressure and/or rate of change of pressure; and a protective cover for locating outside of the chamber and over the burst disc diaphragm, the protective cover being spaced apart from the burst disc diaphragm to form a cavity with an opening for venting fluid from the cavity, the protective cover configured to open at the condition.

14. The overpressure protection system of claim 13, comprising:

one more mounts for fixing the protective cover relative to the wall of the magazine, the one more mounts configured to space the protective cover apart from the burst disc diaphragm; and a baffle wall which extends around, and is spaced apart from, the periphery of the protective cover to define a part of a flow path between the cavity and the cavity opening.

15. A vehicle comprising a magazine fitted with the overpressure protection system of claim 13.

16. An overpressure protection system for a magazine for storing explosive materials, the magazine comprising a wall which defines an internal chamber for housing the explosive materials, with an aperture defined in the wall, the overpressure protection system comprising:

a burst disc diaphragm for covering the aperture, the burst disc diaphragm including a weakened region configured to fail if a condition is met, the condition defined as a function of pressure and/or rate of change of pressure; and a protective cover for locating outside of the chamber and over the burst disc diaphragm, the protective cover configured to open if the condition is met, wherein the protective cover includes a panel pivotably mounted by a hinge, such that the panel is in a first position when the aperture is closed, and the panel is in a second position when the aperture is open.

17. The overpressure protection system of claim 16, wherein the panel is held in the first position by a mount, the mount comprising a frangible component configured to break if the condition being met, thereby allowing the panel to transition to the second position.

18. A vehicle comprising a magazine fitted with the overpressure protection system of claim 16.

* * * * *